US005928785A

United States Patent [19]

Nishida et al.

[11] Patent Number: 5,928,785

[45] Date of Patent: Jul. 27, 1999

[54] FINE INORGANIC PARTICLES-CONTAINING FIBERS AND METHOD FOR FORMING THE SAME

[75] Inventors: Ryosuke Nishida, Okayama-ken; Hiroshi Ono, Okayama, both of Japan

[73] Assignee: Japan Exlan Company Limited, Osaka, Japan

[21] Appl. No.: 08/935,487

[22] Filed: Sep. 24, 1997

[30] Foreign Application Priority Data

Nov. 7, 1996 [JP] Japan ..... 8-312766

[51] Int. Cl.[6] ..... D02G 3/00

[52] U.S. Cl. ..... 428/372; 428/394

[58] Field of Search ..... 428/372, 394

[56] References Cited

U.S. PATENT DOCUMENTS 4,091,066 5/1978 Suzuki et al. ..... 264/182
5,002,988 3/1991 Ono et al. ..... 524/100
5,213,892 5/1993 Bruckner ..... 428/372
5,262,234 11/1993 Minor et al. ..... 428/372
5,344,673 9/1994 Hotta et al. ..... 427/195
5,382,624 1/1995 Hotta et al. ..... 525/10
5,472,818 12/1995 Hotta et al. ..... 430/109
5,609,957 3/1997 Page et al. ..... 428/372
5,681,512 10/1997 Shiota et al. ..... 264/101

*Primary Examiner*—Newton Edwards
*Attorney, Agent, or Firm*—Roland Plottel

[57] ABSTRACT

Disclosed herein is fine inorganic particles-containing fiber which is characterized in that the fiber contains fine inorganic particles with an average particle size of not larger than 10 $\mu$m and the fiber-forming polymer contains not less than 0.01 milliequivalent/gram of any of the polar groups consisting of sulfonic acid group, carboxyl group and phosphoric acid group.

6 Claims, No Drawings

FINE INORGANIC PARTICLES-CONTAINING FIBERS AND METHOD FOR FORMING THE SAME

TECHNICAL FIELD OF THE INVENTION

The present invention relates to fibers containing fine inorganic particles which contain fine inorganic particles in a high concentration, are capable of efficiently revealing the function of said fine inorganic particles, have good processability to give a product using the fibers as starting materials such as paper, nonwoven fabric, woven fabric and knitted textile and have fibrous characteristics whereby sufficient physical property as fiber products is achieved and it also relates to a method for forming said fibers.

PRIOR ART

When the adding amount of fine inorganic particles to fiber is increased in the conventional fiber containing fine inorganic particles, there is a problem that dropping of the fine inorganic particles increases resulting in generation of process pollution, pollution and abrasion of productive equipments and worsening of unit consumption. Further, when the content of the fine inorganic particles becomes more, there is another problem that, since adhesion of the fine inorganic particles to polymer is poor, said particles in the fiber-forming polymer become a defective part as a result causing a decrease in textile strength or causing a snapping of the filament whereby no fiber is obtained. As the measures solving those problems, there have been many proposals on compounded fiber in which the inner part which is a fine inorganic particle layer consisting of polymer containing fine inorganic particles and the outer part which is a protective layer consisting of a fiber-forming polymer are compounded.

[Problems to be Solved by the Invention]

However, in such a compounded fiber, although the dropping of fine inorganic particles can be prevented on the surface in the direction of the fibrous axis (side of the fiber) and the above-mentioned problems can be prevented, the dropping takes place in the vertical direction to the fibrous axis (i.e., cut cross section), the fine inorganic particles are exposed in a bare status whereby problems such as a process pollution and a pollution to equipment are resulted. Said problems become serious especially when the fiber is used in a short-cut form such as in the case of paper manufacture. Further, in such a compounded structure, physical property of the fiber is made so as to durable to the processing steps thereafter and, therefore, the protective layer is to be made somewhat thick. Accordingly, the inner fine inorganic particle layer becomes thin and, as a result, content of the fine particles becomes less and the function of the fine particles is not achieved. On the other hand, when it is necessary to make the content as much as possible to achieve the function, it is necessary to make the protective layer consisting of fiber-productive polymer as thin as possible. In that case, however, there are problems that surface layer is damaged by abrasion of said fiber with the manufacturing equipment of the processing apparatus whereby the inner fine inorganic particles are fallen off or physical property of the fiber is deteriorated.

[Means to Solve the Problems]

The present inventors have conducted an intensive study on the fiber which contains fine inorganic particles. As a result of the study, the present inventors have found that, when a high-molecular substance having polar groups which is adsorbed with the interface of the fine inorganic particles or has a high affinity with the interface of the fine inorganic particles is used as a fiber-forming polymer, it is now possible to give a fiber which is capable of containing fine inorganic particles in a high concentration, keeps good physical property of the fiber and has no problem of dropping of the fine inorganic particles whereby the present invention has been accomplished. Thus, the present invention relates to the fine inorganic particles-containing fiber which is characterized in that the fiber contains fine inorganic particles with an average particle size of not larger than 10 μm and the fiber-forming polymer contains not less than 0.01 milliequivalent/gram of any of the polar groups consisting of sulfonic acid group, carboxyl group and phosphoric acid group and it also relates to a method for the manufacture of fine inorganic particles-containing fiber which is characterized in that a fiber-forming polymer containing not less than 0.01 milliequivalent/gram of any of the polar groups consisting of sulfonic acid group, carboxyl group and phosphoric acid group is mixed with fine inorganic particles with an average particle size of not larger than 10 μm followed by spinning.

EMBODIMENTS OF THE INVENTION

The present invention will now be further illustrated as hereunder. It is necessary that an average particle size of the fine inorganic particles which can be contained in the fine inorganic particles-containing fiber of the present invention is not larger than 10 μm. In the present invention, the polar group such as sulfonic acid group, carboxyl group and phosphoric acid group in the fiber-forming polymer acts onto the interface of fine inorganic particles whereby said particles are homogeneously dispersed and are also strongly carried with said polymer. Therefore, if the average particle size is larger than 10 μm, the area of the acting interface is extremely small and does not function well and, accordingly, the merit of the present invention is not achieved. On the other hand, when the particle size is not larger than 10 μm, the interface where the polar group acts is large and, the smaller the particle size, the larger the interface area whereby the above-mentioned action is effectively achieved giving preferred results. Particularly good results are available when the average particle size is 3 μm or smaller and the maximum particle size is 5 μm or smaller. Most preferably, both average and maximum average sizes are 1 μm or smaller whereby a significant results are achieved.

There is no particular limitation for the fine inorganic particles which can be contained in the fine inorganic particles-containing fiber of the present invention and any fine inorganic particles may be used so far as they have a function which is requested depending upon the actual use. Examples are oxides such as silica, diatomaceous earth, alumina, zinc oxide, titanium oxide, calcium oxide, magnesium oxide, iron oxide, tin oxide, indium-tin oxide (ITO), antimony oxide, cerium oxide and ferrite; hydroxides such as calcium hydroxide, magnesium hydroxide, aluminum hydroxide and basic magnesium carbonate; carbonates such as calcium carbonate, magnesium carbonate, zinc carbonate, barium carbonate, dawsonite and hydrotalcite; sulfates such as calcium sulfate, barium sulfate and gypsum; silicates such as calcium silicate (wollastonite and xonotlite), talc, clay, mica, montmorillonite, bentonite, activated clay, sepiolite, imogolite, sericite and glass; nitrides such as aluminum nitride, boron nitride and silicon nitride; carbons such as carbon black, black lead, graphite, charcoal powder and activated carbon powder; and others such as potassium titanate, lead titanate zirconate, barium titanate, aluminum borate, molybdenum sulfide, silicon carbide, zinc borate, magnetic samarium-cobalt and magnetic neodymium. Especially when ferrite, zeolite, silica, aluminum hydroxide, glass, montmorillonite, carbon black, graphite, iron powder, copper powder, etc. having a high practical value among the above are used, it is possible to give highly-functional products.

There is no limitation for the shape of the fine inorganic particles and any of polygons, needles, spheres, cubes, spindles, plates, etc. may be used but, in view of dispersibility and abrasion resistance, spheres or spindles are preferred.

With respect to the content of the above-mentioned fine inorganic particles, it may be appropriately selected so as to achieve the function necessary for the actual use and there is no particular limitation for that. However, the material which is capable of sufficiently giving its function in any use is easy to apply to broad areas of use in actual use and is advantageous in terms of production and cost. In view of the above, for achieving a good result, it is preferred to make the content of the fine inorganic particles 5% by volume or more or, more preferably, the content is 25% by volume or more.

The characteristic features of the fine inorganic particles-containing fibers of the present invention are that the fine inorganic particles are contained in a fiber-forming polymer in a high concentration and also in a homogeneously dispersed state and further that the fine particles hardly drop from the fiber after the fiber production. In order to achieve such characteristic features, it is necessary that the fiber-forming polymer used in the present invention contains not less than 0.01 milliequivalent/gram of any polar group selected from sulfonic acid group, carboxyl group and phosphoric acid group. When said polar group is contained in the polymer, said polar group is oriented on and adsorbed with the surface of the fine inorganic particles whereby the surface of the fine inorganic particles is covered by a fiber-forming polymer. As a result, the fine inorganic particles can be homogeneously dispersed in the fiber-forming polymer using a part of the fiber-forming fiber as protective and dispersing layers. Further since the affinity with said polymer becomes high by such a mechanism, the dropping of the fine inorganic particles from said polymer can be prevented as well.

The amount of said polar group selected from sulfonic acid group, carboxyl group and phosphoric acid group may be appropriately selected depending upon the amount and the particle size of the existing fine inorganic particles. However, from the practical viewpoint, it is necessary to contain 0.01 milliequivalent/gram or more for carrying the sufficient amount of the fine inorganic particles to achieve the function. In addition, with respect to the amount of said polar group, the more said amount, the more advantageous for the cases when it is attempted to make the content of the fine inorganic particles more or to use fine inorganic particles having particle size of 1 $\mu$m or less and having a big surface area. In view of the above, better result is obtained when the amount is 0.03 milliequivalent/gram or more.

Said polar group may be an acid type of each of the polar groups or a salt type of any of such acids. Examples of the salt are Na, Li, K, Mg, Ca, Cu, Fe and $NH_3$. Incidentally, the definition for sulfonic acid includes sulfuric acid group (—OSO3—) and that for phosphoric acid includes phosphate such as mono-, di- and tri-esters of phosphoric acid.

There is no particular limitation for a method of introducing said polar group so far as the necessary amount of any of sulfonic acid, carboxyl and phosphoric acid groups can be made contained therein. Examples are a method in which a monomer containing said polar group is copolymerized and a method in which said polar group is introduced to the end of a molecule as an initiator for polymerization or as a chain-transfer agent. Specific examples of a monomer containing said polar group in the former method in case of a radical polymerization system are carboxyl group-containing vinyl monomers such as acrylic acid, methacrylic acid, crotonic acid, itaconic acid, maleic acid, fumaric acid, aconitic acid, citraconic acid and mesaconic acid; sulfonic acid group-containing vinyl monomers such as styrenesulfonic acid, vinyltoluenesulfonic acid, vinylethylbenzenesulfonic acid, isopropenylbenzenesulfonic acid, 2-chlorostyrenesulfonic acid, 2,4-dichlorostyrenesulfonic acid, 2-methyl-4-chlorostyrenesulfonic acid, vinyloxybenzenesulfonic acid, vinylsulfonic acid, methallylsulfonic acid, allylsulfonic acid, sulfoethyl or sulfopropyl methacrylate or acrylate, 2-acrylamido-2-methylpropanesulfonic acid and methacryloyloxyethanesulfonic acid; and phosphoric acid group-containing monomers such as acid phosphoxyethyl methacrylate, acid phosphoxyethyl acrylate, 3-chloro-2-acid phosphoxypropyl methacrylate, 3-chloro-2-acid phosphoxypropyl acrylate, acid phosphoxypropyl methacrylate and acid phosphoxypropyl acrylate while examples in case of a condensation polymerization system are sulfonic acid group-containing aromatic dicarboxylic acid such as sulfoterephthalic acid, 5-sulfoisophthalic acid, 4-sulfophthalic acid, 4-sulfonaphthalene-2,7-dicarboxylic acid and 5-(4-sulfophenoxy)-isophthalic acid and salts of those acids. Examples of the salt type are Na, Li, K, Mg, Ca, Cu, Fe and $NH_3$.

In a latter method wherein said polar group is introduced to an end of a molecule as an initiator for polymerization or as a chain-transfer agent, examples in the case of a radical polymerization are azo compounds and peroxides having said polar group such as disuccinic acid peroxide, dimaleic acid peroxide and 4,4-azobis(4-cyanovaleric acid). Examples of an initiator which generates sulfurous acid radical ($.SO^{3-}$) or sulfuric acid radical ($.OSO^{3-}$) are sulfuric acid, disulfuric acid, peroxomonosulfuric acid, peroxodisulfuric acid, thiosulfuric acid, dithionic acid, sulfurous acid, disulfurous acid, thiosulfurous acid, dithionous acid, sulfoxylic acid, polythionic acid and/or salts thereof and they are to be used as at least one of oxidizing and reducing agents. When used as one of them, another may be a known oxidizing or reducing agent and, for example, combinations such as potassium peroxodisulfate or ammonium peroxodisulfate with sodium sulfite; peroxodisulfuric acid with sodium hydrogen sulfite; sodium chlorate with sodium dithionite; and ferric sulfate with thiosulfuric acid are industrially preferred combinations as redox catalyst. Examples of the chain-transfer agent having a polar group are mercaptopropionic acid, 2-mercaptoethylsulfonic acid, mercaptoacetic acid and 3-mercaptopropylsulfonic acid.

There is no particular limitation for the fiber-forming polymer of the present invention so far as it exhibits an ability of forming fiber and it may be any of natural, semi-synthetic and synthetic polymers. Specific examples of the polymer are plastic polymers such as polyethylene, polypropylene, vinyl chloride, ABS resin, nylon, polyester, poly(vinylidene chloride), polyamide, polystyrene, polyacetal, polycarbonate, acryl resin, fluorine resin, polyurethane elastomer, polyester elastomer, melamine resin, urea resin, ethylene tetrafluoride resin, unsaturated polyester resin, epoxy resin, urethane resin and phenol resin; general fiber-forming polymers such as nylon, polyethylene, rayon, acetate, acryl, polyvinyl alcohol, polypropylene, cupro, triacetate and vinylidene; and natural rubber and synthetic rubber polymers such as natural silicone rubber, SBR (styrenebutadiene rubber), CR (chloroprene rubber), EPM (ethylenepropylene rubber), FPM (fluorinated rubber), NBR (nitrile rubber), CSM (chlorosulfonated polyethylene rubber), BR (butadiene rubber), IR (synthetic natural rubber), IIR (butyl rubber), urethane rubber and acryl rubber. In general, it is often that the surface of fine inorganic particles is hydrophilic affected by water adhered to the surface and, therefore, the fiber-forming polymer used as a partner is preferably a polymer which can be spun by aqueous or hydrophilic solvent or a polymer which is highly hydrophilic as it is such as polyacrylonitrile, polyamide and polyvinyl alcohol. Particularly good result is achieved when polyacrylonitrile, i.e. polymer of an acrylonitrile type, is used.

With regard to the acrylonitrile polymer, it is preferred in terms of physical property of the fiber to use a polymer of just acrylonitrile or a copolymer of a monomer mixture consisting of not less than 50% by weight (preferably, not less than 85% by weight) of acrylonitrile and at least one other ethylenic unsaturated compound as a remainder. Examples of other ethylenic unsaturated compounds to be copolymerized with acrylonitrile are vinyl and vinylidene halides, ethylenic unsaturated carboxylic acids and salts thereof, acrylates and methacrylates, vinyl esters, unsaturated hydrocarbon sulfonic acids and salts thereof, vinyl compounds such as styrene and alkylated or halogenated compounds thereof and vinyl compounds containing a basic group such as dimethylaminoethyl methacrylate. Any one or more of them among the above may be used.

There is no particular limitation for the fibrous property of the fine inorganic particles-containing fiber of the present invention so far as the fiber has a property which is necessary for the actual use. However, its monofilament strength and monofilament elongation are preferably not less than 1 MPa and not less than 1%, respectively, in terms of good processability of the fiber for making into paper, nonwoven fabric, woven fabric, knitted textile, etc. When the monofilament strength is less than 1 MPa and the monofilament elongation is less than 1%, there may be a problem of breakage of the fine inorganic particles-containing fiber due to stirring upon the paper manufacture or a problem of insufficient strength and softness of the paper itself containing said fiber even as a fiber for the paper where the required monofilament strength and elongation are minimum. In order to manufacture a product having higher processability, it is more preferred that the monofilament strength and elongation are not less than 10 MPa and not less than 5%, respectively.

There is no particular limitation for the monofilament diameter of the fine inorganic particles-containing fiber of the present invention but it may be appropriately selected although the range from 1 $\mu$m to 100 $\mu$m gives preferred results. Average particle size of the fine inorganic particles to be added may be selected depending upon the diameter of the fiber. However, when the monofilament diameter is less than 1 $\mu$m, diameter of the fiber is too small as compared with the average particle size of the fine inorganic particles and, therefore, continuity of the fiber-forming organic high-molecular matrix lowers too much whereby a product having a desired fibrous property cannot be obtained. On the other hand, when the monofilament diameter is more than 100 $\mu$m, softness as a fiber are insufficient and, therefore, there may be a problem during the processing steps or a problem of insufficient softness and flexibility when it is made into a product.

The fine inorganic particles in the fine inorganic particles-containing fiber of the present invention are strongly carried within a fiber-forming polymer due to the above-mentioned polar group contained in the fiber-forming polymer. Therefore, dropping of the fine inorganic particles from the fiber is little and it is now possible to eliminate the problems of generation of step pollution, pollution of production equipments, abrasion and worsening of unit requirement. Thus, one of the characteristic features of said fiber according to the present invention is that the ratio of dropping (which will be defined later) of the fine inorganic particles from the fine inorganic particles-containing fiber is low and, in the case of the present invention, good result is achieved when said ratio is not more than 0.03% by weight.

Definition of ratio of dropping is as follows. Thus, in accordance with "Method of Preparation of Handmade Paper for Pulp Test" (JIS-P8209), a liquid containing fine inorganic particles-containing fiber having a length of 0.5 cm is subjected to a disintegrating operation at 3,000 rpm (revolutions of a disintegrating fan) for one hour, the disintegrated liquid is made into paper by the method defined in said JIS, the weight of the fine inorganic particles contained in the waste water obtained thereby is divided by the weight of the fine inorganic particles in the test sample followed by being multiplied by 100 and the resulting value in terms of % by weight is defined as a ratio of dropping. In more specific detail, about 24 g (absolutely dry weight) of the fine inorganic particles-containing fiber having a length of 0.5 cm is weighed and placed in a standard disintegrator together with about 2,000 ml of water (about 20° C.), said liquid is subjected to a disintegrating operation at 3,000 rpm (revolutions of the disintegrating fan) for one hour and the disintegrated material is diluted to a concentration of 0.15% by weight with water (about 20° C.). Then, in accordance with a method defined under "3.2 Preparation of Hand-Made Paper" in the same JIS, said disintegrated liquid is made into paper, the waste water obtained thereby is dried with hot air, amount of the fine inorganic particles contained in the waste water is weighed, the weight is divided by the weight of the fine inorganic particles contained in the test sample (fine inorganic particles-containing fiber) followed by being multiplied by 100 and the resulting value in terms of % by weight is defined as a ratio of dropping.

For manufacturing the fine inorganic particles-containing fiber of the present invention, it is necessary that fine inorganic particles having an average particle size of not larger than 10 $\mu$m are mixed with a fiber-forming polymer containing not less than 0.01 milliequivalent/gram of any of the polar groups consisting of sulfonic acid, carboxyl and phosphoric acid groups followed by spinning. It is not easy to homogeneously disperse the fine inorganic particles into the fiber-forming polymer which is an organic substance and, usually, it has been attempted to disperse at a high stirring rate for long time or to apply a shear by means of beads mill, extruder, etc. However, it is hard to give a good dispersion of organic and inorganic substances which are inherently different in their surface characteristics. Other problems are that, when the particle size becomes smaller, van der Waals force becomes stronger whereby the particles are apt to be coagulated and that, when the adding amount becomes larger, distances among the particles become smaller whereby coagulation is apt to take place. However, in the present invention, the above-mentioned groups are contained in the polymer and, therefore, said polar group is oriented to and adsorbed with the surface of the fine inorganic particles whereby a part of the fiber-forming polymer covers the surface of the fine inorganic particles and said particles can now be homogeneously dispersed in the fiber-forming polymer using a part of the fiber-forming polymer as a protective/dispersing layer. As a result thereof, it is now possible to make the content of the fine inorganic particles high and, at the same time, snapping during the spinning and elongating stages can be prevented. In addition, affinity with said polymer becomes high and, accordingly, dropping of the fine inorganic particles from said polymer can be prevented as well.

As one of the examples for improving an affinity of the polymer with fine inorganic particles, there is a method wherein surface-active agent having a hydrophilic polar group exhibiting a high affinity with the fine inorganic particles is used. However, in such a method, molecular weight of the surface-active agent is low and, therefore, there are problems that the particles drop when made into a product, hydrophilicity becomes too high in some areas, sustaining ability is poor, coloration and changes in color of the product itself take place, etc. In addition, there are several attempts for a method of surface treatment for giving an affinity to the surface of fine inorganic particles with a polymer but there are problems that revelation of the functions of the fine inorganic particles is disturbed and that, due to a high difficulty in a uniform surface treatment of each of the fine particles, the manufacturing cost therefor becomes high. As compared with those methods, the characteristic feature of the present invention is that a polar group having an affinity with fine inorganic particles is made contained in the fiber-forming polymer itself whereby the above-mentioned problems can be solved.

With regard to a spinning method for the present invention, any of melt spinning, wet spinning and dry spinning methods is applicable and an appropriate method can be selected depending upon the property of the fiber-forming polymer. However, surface of the fine inorganic particles used in the present invention has a hydrophilicity in many cases and, therefore, it is preferred to conduct a wet spinning method using an aqueous solvent such as aqueous solution of sodium thiocyanate, aqueous solution of zinc chloride and nitric acid or an organic solvent which is well miscible with water such as dimethylformamide (DMF), dimethyl sulfoxide (DMSO), dimethylacetamide (DMAc) and N-methyl-pyrrolidone (NMP). Further, an organic polymer containing acrylonitrile polymer having a high affinity with the surface of fine inorganic particles often gives preferred result.

[Functions]

In the present invention, a polar group having a high affinity with the surface of the fine inorganic particles is contained in the fiber-forming polymer whereupon said polar group is oriented on and adsorbed with the surface of the fine inorganic particles and a part of the fiber-forming polymer covers the surface of the fine inorganic particles. Accordingly, it is now possible that the fine inorganic particles are homogeneously dispersed in the fiber-forming polymer using a part of the fiber-forming polymer as a protective/dispersing layer. It is believed that, as a result thereof, the content of the fine inorganic particles can be made high and, at the same time, snapping during the spinning and elongating stages can be prevented and further that dropping of the fine inorganic particles from said polymer can be prevented.

EXAMPLES

The present invention will now be further illustrated by way of the following examples which, however, do not limit the scope of the present invention. Incidentally, the terms "part (s)" and "%" used in the examples are those by weight. First, various measuring methods will be mentioned.

With respect to an average particle size of the fine inorganic particles, the result of the measurement by a measuring device for particle size distribution of a laser diffraction type (SALD 2000; manufactured by Shimadzu) using water as a dispersing medium was expressed based upon volume and its median diameter was adopted as an average particle size.

With respect to the amount of sulfonic acid group, carboxyl group and phosphoric acid group contained in the fiber-forming polymer, an acid-base titration depending upon each of them was conducted and the amount of each polar group was determined from the resulting titration curve.

With respect to the ability of revealing the function of the fine inorganic particles, evaluation was conducted by an appropriate selection among the four characters (electroconductivity, light-heat converting property, magnetic property and hygroscopic property) depending upon the function of the fine inorganic particles. Among the four, electroconductivity was evaluated by means of an intrinsic resistance ρ (ohms.cm). The less the intrinsic resistance, the higher the electroconductive effect of the fiber.

Thus, a bundle of fiber having a length of 5 cm consisting of five monofilaments held at both ends was applied with a voltage of 100 volts in an atmosphere of 40% relative humidity at 20° C. to measure the resistance R (unit: ohms). From the value of R measured as such, the intrinsic resistance ρ was calculated by the following formula.

$$\rho(\text{ohms.cm})=[R\times(\text{deniers of sample fiber}\times10^5)]/[45\times\text{specific gravity of sample fiber}]$$

With respect to light-heat converting property, surface of a sheet of paper (60 g/m$^2$) manufactured from a test fiber was irradiated for ten minutes with a reflective lamp used in photography (500 watts) (having a spectrum like that of sunlight and a color temperature [5500° K.] similar to that [6000° K.] of sunlight) as a light source, then the temperature of the back of said sheet was measured by a thermographic device and the light-heat converting effect was evaluated in terms of the difference in temperature rises (°C.) between the fiber which contains the fine inorganic particles and that which contains no such particles. Accordingly, the more the resulting value, the better the light-heat converting property.

With respect to the ability of revealing the function of fine inorganic particles having a magnetic property, the evaluation was conduced by measuring the surface magnetism of a sheet of paper of 60 g/m$^2$ manufactured from a test fiber. Magnetization was conducted by a magnetizing yoke where the interval between N and S was 2 mm under the condition of applying 5 A of current. Then the residual magnetism (gauss; G) on the surface of the magnetized sample was measured and the evaluation was made that the more said magnetism, the more the revealing ability of magnetic function.

Measurement of hygroscopicity (%) was conducted as follows. Thus, about 5.0 g of a test fiber was dried in a vacuum drier at 70° C. for 12 hours and weighed (W1 in grams). Then the sample was humidified for 24 hours by placing in a thermostat of relative humidity of 65% at 20° C. Weight of the sample which was humidified as such was measured (W2 in grams). Hygroscopicity was calculated from the above results by the following formula.

$$\text{Hygroscopicity }(\%)=(W1-W2)/W1\times100$$

Example 1

Acrylonitrile (70 parts), 7 parts of methyl acrylate and 0.5 part of sodium styrenesulfonate were added as monomers to 1,000 parts of nitrogen-substituted water, then 0.5 part of sodium acidic sulfite and 0.5 part of ammonium persulfate were added as initiators thereto and the mixture was raised to 50° C. and polymerized for two hours. As a result, copolymer of acrylonitrile/methyl acrylate/sodium styrenesulfonate (weight average molecular weight: 89,000) was obtained and said copolymer contained 0.052 milliequivalent (hereinafter, referred to as "meq") per gram of sulfonic acid group as a polar group.

Then 40 g of the resulting copolymer was dissolved in 500 g of a 55% aqueous solution of sodium thiocyanate at 73° C., 60 parts of fine particles of tin oxide having an average particle size of 0.3 μm was added and the mixture was stirred for five hours to homogeneously disperse said fine particles of tin oxide whereupon a solution for spinning was prepared. Said solution was spun into a 15% aqueous solution of sodium thiocyanate of −2° C. from a nozzle having 5,000 pores with a pore diameter of 0.07 mm, washed with water, elongated (total elongation ratio: 12), dried/tightened, crimped, heat-treated mildly and treated with oil to give a fiber (monofilament diameter: 22 μm) containing fine particles of tin oxide. Said fiber was evaluated and found to exhibit monofilament strength of 82 MPa, monofilament elongation of 20% and knot tenacity of 35 MPa showing that it had a fiber property which can be well competent to the treatment thereafter. An intrinsic resistance of the resulting fiber was measured and found to be $3.5\times10^{0}$ (ohms.cm) which well revealed the electroconductivity of the fine inorganic particles. When paper of 60 g/m$^2$ was hand-made using said fiber, the ratio of dropping was 0.01% and turbidity of waste water and step pollution were rarely noted.

Example 2

The same operation as in Example 1 was conducted except that silica gel of an average particle size of 0.4 μm was used instead of tin oxide and that its amount was made 38.9% by volume whereupon the fiber containing fine particles of silica gel was obtained. Properties and characteristics of said fiber are as shown in Table 1 where fibrous property is good and hygroscopicity is 21% which well reveals the hygroscopicity of fine particles of silica gel. In addition, waste water from the paper manufacture was not turbid but satisfactory.

TABLE 1

| Examples | 2 | 3 | 4 | 5 |
|---|---|---|---|---|
| Type of Polar Group Used | SA | SA | SA | SA |
| Amount of Polar Group (meq/g) | 0.052 | 0.052 | 0.052 | 0.052 |
| Type of Fine Inorganic Particles | SG | SF | HF | SF |
| Particle Size of FIP (μm) | 0.4 | 0.1 | 0.2 | 2.0 |
| Amount of FIP (% by volume) | 38.9 | 33.7 | 39.5 | 8.5 |
| Amount of FIP (% by weight) | 65 | 70 | 75 | 30 |
| Spinning Method | WS | WS | WS | WS |
| Monofilament Strength (MPa) | 102 | 110 | 63 | 45 |
| Monofilament Elongation (%) | 18 | 23 | 15 | 23 |
| Monofilament Diameter (μm) | 25 | 21 | 23 | 28 |
| Ratio of Dropping (% by weight) | 0.02 | 0.005 | 0.008 | 0.012 |
| Light-Heat Conversion (° C.) | | 8 | | 6 |
| Magnetism (G) | | | 48 | |
| Hygroscopicity (%) | 21 | | | |

FIP: fine inorganic particles
SA: sulfonic acid polar group

TABLE 1-continued

| Examples | 2 | 3 | 4 | 5 |
|---|---|---|---|---|

SG: silica gel
SF: soft ferrite
HF: hard ferrite
WS: wet spinning

Example 3

The same operation as in Example 1 was conducted except that fine particles of soft ferrite of an average particle size of 0.1 μm was used instead of tin oxide and that its amount was made 33.7% by volume whereupon the fiber containing fine particles of soft ferrite was obtained. Properties and characteristics of said fiber are as shown in Table 1 where fibrous property is good and light-heat converting property is 8° C. which well reveals the light-heat converting property of fine particles of ferrite. In addition, dropping of fine particles of ferrite during manufacture was not noted and neither coloration of waste water nor pollution of devices in paper manufacture was noted but satisfactory.

Example 4

The same operation as in Example 1 was conducted except that fine particles of hard ferrite of an average particle size of 0.2 μm was used instead of tin oxide and that its amount was made 39.5% by volume whereupon the fiber containing fine particles of hard ferrite was obtained. Properties and characteristics of said fiber are as shown in Table 1 where fibrous property is good and magnetic retention is 48 gausses which well reveals the magnetic character of fine particles of ferrite. In addition, neither dropping of fine particles of ferrite nor pollution of devices during spinning was noted and no coloration of waste water was noted but satisfactory.

Example 5

The same operation as in Example 1 was conducted except that fine particles of soft ferrite of an average particle size of 2.0 μm was used instead of tin oxide and that its amount was made 8.5% by volume whereupon the fiber containing fine particles of soft ferrite was obtained. Properties and characteristics of said fiber are as shown in Table 1 where there is no problem in the after-treating steps and fibrous property is good. In addition, light-heat converting property is 6° C. which well reveals the light-heat converting property of fine particles of ferrite. Further, dropping of fine particles of ferrite during manufacture was not noted and both coloration of waste water and pollution of devices in the paper manufacture was rarely noted but satisfactory.

Example 6

The same polymerization operation as in Example 1 was conducted except that 0.3 part of sodium methallylsulfonate was used instead of 0.5 part of sodium styrenesulfonate and, as initiators, 0.3 part of sodium chlorite and 0.4 part of sodium dithionite were used to give a copolymer of acrylonitrile/methyl acrylate/sodium methallylsulfonate having a weight average molecular weight of 120,000. Said copolymer contained 0.03 meq/g of sulfonic acid group as a polar group.

The resulting acrylonitrile polymer was treated by the same manner as in Example 1 to give a fiber which contained fine particles of tin oxide. Properties and characteristics of said fiber are as shown in Table 2 where fibrous property is good having the properties fitting for the processes such as after-treatment. The intrinsic resistance was measured and found to be $8.9\times10^{0}$ (ohms.cm) which well revealed the electroconductivity of the fine inorganic particles. In addition, in the paper manufacture test using said fiber, turbidity of waste water and process pollution were hardly noted whereby it was confirmed that fine particles of tin oxide were well retained in the fiber.

TABLE 2

| Examples | 6 | 7 | 8 | 9 | 10 |
|---|---|---|---|---|---|
| Type of Polar Group Used | SA | CSA | PSA | SA | SA |
| Amount of Polar Group (meq/g) | 0.03 | 0.078 | 0.04 | 0.04 | 0.052 |
| Type of Fine Inorganic Particles | TO | TO | SG | SG | TO |
| Particle Size of FIP (μm) | 0.3 | 0.3 | 0.4 | 0.4 | 0.3 |
| Arnount of FIP (% by volume) | 26.5 | 26.5 | 38.9 | 23.1 | 4.1 |
| Arnount of FIP (% by weight) | 60 | 60 | 65 | 50 | 15 |
| Spinning Method | WS | WS | WS | MS | MS |
| Monofilament Strength (MPa) | 75 | 78 | 89 | 140 | 92 |
| Monofilament Elongation (%) | 25 | 24 | 24 | 23 | 28 |
| Monofilament Diameter (μm) | 23 | 24 | 21 | 65 | 18 |
| Ratio of Dropping (% by weight) | 0.02 | 0.01 | 0.004 | 0.005 | 0.002 |
| Inherent resistance (Ω · cm) | $8.9\times10^{0}$ | $6.5\times10^{0}$ | | | $6.7\times10^{9}$ |
| Hygroscopicity (%) | | | 26 | 18 | |

FIP: fine inorganic particles
SA: sulfonic acid polar group
CSA: carboxylsulfonic acid group
PSA: phosphoric sulfonic acid group
TO: tin oxide
SG: silica gel
WS: wet spinning
MS: melt spinning

Example 7

The same polymerization operation as in Example 1 was conducted except that 0.6 part of methacrylic acid was used instead of 0.5 part of sodium styrenesulfonate to give a copolymer of acrylonitrile/methyl acrylate/methacrylic acid having a weight average molecular weight of 78,000. Said copolymer contained 0.078 meq/g, in total, of carboxyl and sulfonic acid groups as polar groups.

The resulting acrylonitrile polymer was treated by the same manner as in Example 1 to give a fiber which contained fine particles of tin oxide. Properties and characteristics of said fiber are as shown in Table 2 where fibrous property is good having the properties fitting for the processes such as after-treatment. The intrinsic resistance was measured and found to be $6.5\times10^{0}$ (ohms.cm) which well revealed the electroconductivity of the fine inorganic particles. In addition, in the paper manufacture test using said fiber, turbidity of waste water, process pollution, etc. were hardly noted whereby it was confirmed that the fine particles of tin oxide were well retained in the fiber.

Example 8

The same polymerization operation as in Example 1 was conducted except that 0.5 part of acid phosphoxyethyl methacrylate was used instead of 0.5 part of sodium styrenesulfonate to give a copolymer of acrylonitrile/methyl acrylate/acid phosphoxyethyl methacrylate having a weight average molecular weight of 98,000. Said copolymer contained 0.04 meq/g, in total, of phosphoric acid and sulfonic acid groups as polar groups.

The resulting acrylonitrile polymer was treated by the same manner as in Example 2 to give a fiber which contained fine particles of silica gel. Properties and characteristics of said fiber are as shown in Table 2 where fibrous property is good being able to be made into cloth. Hygroscopicity was 26% which well revealed the hygroscopicity of fine particles of silica gel. In addition, in the paper manufacture, turbidity of waste water was not noted and there was no problem about that.

Example 9

Fine particles of silica gel (50 parts) having an average particle size of 0.4 μm were mixed with 50 parts by weight of polyethylene terephthalate containing 0.5% of sulfoterephthalic acid having an intrinsic viscosity of 0.75, the mixture was spun at a spinning temperature of 280° C. from an orifice having a diameter of 0.10 mm, rolled round a reel at the rate of 800 m/min together with oiling, elongated at 90° C. to an extent of elongating ratio of 2.5 and heated at 150° C. with tension to give a fiber containing fine particles of silica gel having a filament diameter of 65 μm. Properties of the resulting fiber were as shown in Table 2 whereby the fibrous properties were good and being well fitted for the after-treatment. Hygroscopicity was 18% which well revealed the hygroscopicity of fine particles of silica gel. In addition, in the paper manufacture, no turbidity was noted in waste water and there was no problem about that.

Example 10

The same operation as in Example 1 was conducted except that the amount of tin oxide to be added was changed to 4.1% by volume to give the fiber containing fine particles of tin oxide. As shown in Table 2, its fibrous properties, etc. were in a level of no problem. Intrinsic resistance was $6.7\times10^{9}$ (ohms.cm) and, as compared with the fiber containing no additive, it was confirmed that the electroconductive function by addition of fine particles of tin oxide was slightly revealed although the level was considerably low. This result will show that, since the adding amount of tin oxide was little, contact among tin oxide particles hardly took place and, as a result, electroconductivity was not well revealed.

Comparative Examples

Comparative Example 1

Manufacture of fiber was attempted by the same manner as in Example 5 except that soft ferrite particles having an average particle size of 12 μm but a rise in pressure in the nozzle was so high that continuous manufacture of fiber was not possible. Physical properties and characteristic of the resulting fiber are as shown in Table 3. Monofilament strength of the fiber which was obtained only a little was 0.7 MPa and elongation of it was nearly zero. The reason is thought to be as follows. Thus, since the particle size was big, interface area by unit weight of the particle became too small and the particles were not well sustained by the polar group in the fiber-forming polymer whereby problems such as insufficient dispersing were generated giving such a result.

TABLE 3

| Comparative Examples | 1 | 2 |
|---|---|---|
| Type of Polar Group Used | SA | SA |
| Amount of Polar Group (meq/g) | 0.052 | 0.005 |
| Type of Fine Inorganic Particles | SF | HF |
| Particle Size of FIP (μm) | 12 | 0.2 |
| Amount of FIP (% by volume) | 8.5 | 39.5 |

TABLE 3-continued

| Comparative Examples | 1 | 2 |
|---|---|---|
| Amount of FIP (% by weight) | 30 | 75 |
| Spinning Method | WS | WS |
| Monofilament Strength (MPa) | 0.7 | 35 |
| Monofilament Elongation (%) | 0 | 17 |
| Monofilament Diameter (μm) | 32 | 21 |
| Ratio of Dropping (% by weight) | | 0.50 |
| Light-Heat Conversion (° C.) | Measurement impossible because paper was unable to be manufactured | |
| Magnetism (G) | | 15 |
| Remarks | Unable to be made into fiber and paper | Much dropping during the steps; much polluted in black |

FIP: fine inorganic particles
SA: sulfonic acid polar group
SF: soft ferrite
HF: hard ferrite
WS: wet spinning

Comparative Example 2

The same polymerization operation as in Example 1 was conducted except that no sodium styrenesulfonate was used and that 0.3 part of sodium chlorite and 0.4 part of sodium dithionite were used as initiators to give a copolymer of acrylonitrile/methyl acrylate having a weight average molecular weight of 134,000. Said copolymer had 0.005 meq/g of sulfonic acid group as a polar group.

The resulting acrylonitrile polymer was subjected to the same operation as in Example 4 to give the fiber containing fine particles of hard ferrite. During the spinning, pressures in filter and in nozzle rose with a lapse of time and it was difficult to give the fiber in a stable manner for long time. The reason is thought to be as follows. Thus, since the amount of the polar group by which the fine particles of ferrite were homogeneously dispersed and stabilized was too small, aggregation of the fine inorganic particles took place in the spinning solution whereupon the filter and the nozzle were stopped causing the above result.

Incidentally, the fibrous properties of the fiber which was obtained in the initial stage were in an allowable degree as shown in Table 3. During the manufacturing steps of this fiber however, much dropping of the ferrite was noted whereby the steps were entirely in black and both solvent and washing water, etc. were polluted in black. Therefore, practically, the steps were unable to be adopted. When the resulting fiber was made into paper, the waste water was polluted in black too and that was not in a practically applicable level. The reason is though to be as follows. Thus, the amount of the polar group in the fiber-forming polymer was small whereby adsorption of said polymer with the fine ferrite particles and production of protective layer were insufficient and, further, fine ferrite particles were not able to be well sustained due to the small amount of the polar group whereby a lot of droppings were resulted.

[Merit of the Invention]

The fine inorganic particles-containing fiber in accordance with the present invention contains the fine inorganic particles in the fiber and, accordingly, it is now possible to give a fiber having various functions inherent to the fine inorganic particles such as electroconductivity, magnetism, heat conductivity, piezo-electric property, damping property, sound-insulating property, sliding property, abrasion property, antiblocking property, heat-insulating property, light weight, property of absorbing electro-magnetic wave, property of scattering and reflecting of light, property of radiation of heat rays, flame retarding property, property of UV absorption, property of absorbing radioactive rays, dehydrating property, deodorizing property, antibacterial property, antifungal property, heat accumulating property, improving property of surface nature, property of giving good design, property of giving refreshing feel, electroconductivity, anticorrosive property, lubricity and selective absorption of light. In addition, it is possible to give processed products such as paper, nonwoven fabric, knitted products and woven fabric utilizing the good processability of the fiber. Thus, the fiber is now able to be used in various fields by active utilization of those functions.

What is claimed is:

1. A fiber containing fine inorganic particles which is characterized in that the fiber contains fine inorganic particles with an average particle size of not larger that 10 μm and the fiber-forming polymer contains not less than 0.01 milliequivalent/gram of any of the polar groups selected from the group consisting of sulfonic acid group, carboxyl croup and phosphoric acid group, wherein said fiber contains not less that 5% by volume of the fine inorganic particles.

2. A fiber containing fine inorganic particles which is characterized in that the fiber contains fine inorganic particles with an average particle size of not larder that 10 μm and the fiber-forming polymer contains not less than 0.01 milliequivalent/gram of any of the polar groups selected from the group consisting of sulfonic acid group, carboxyl group and phosphoric acid group, wherein the fiber strength is not less than 1 MPa and the fiber elongation is not less than 1%.

3. The fiber according to claim 1 wherein the fiber-forming polymer is an acrylonitrile polymer.

4. A fiber containing fine inorganic particles which is characterized in that the fiber contains fine inorganic particles with an average particle size of not larder that 10 μm and the fiber-forming polymer contains not less than 0.01 milliequivalent/gram of any of the polar groups selected from the group consisting of sulfonic acid group, carboxyl group and phosphoric acid group, wherein the fine inorganic particles are one or more selected from the group consisting of ferrite, zeolite, silica, aluminum hydroxide, glass montmorillonite, carbon black, graphite,iron powder and copper powder.

5. A fiber containing fine inorganic particles which is characterized in that the fiber contains fine inorganic particles with an average particle size of not larger that 10 μm and the fiber-forming polymer contains not less than 0.01 milliequivalent/gram of any of the polar groups selected from the group consisting of sulfonic acid group, carboxyl group and phosphoric acid group, wherein the ratio of dropping of the fine inorganic particles from the fiber is not more than 0.03% by weight.

6. A fiber containing fine inorganic particles which is characterized in that the fiber contains not less than 25% by volume of fine inorganic particles with an average particle size of not larger than 10 μm and the fiber-forming polymer contains not less than 0.01 milliequivalent/gram of any of the polar groups selected from the group consisting of sulfonic acid group, carboxyl group and phosphoric acid group.

* * * * *